US006771245B2

(12) United States Patent
Kanbe et al.

(10) Patent No.: US 6,771,245 B2
(45) Date of Patent: Aug. 3, 2004

(54) DISPLAY APPARATUS, DISPLAY APPARATUS DRIVING METHOD, AND LIQUID CRYSTAL DISPLAY APPARATUS DRIVING METHOD

(75) Inventors: Makoto Kanbe, Sakurai (JP); Sayuri Fujiwara, Nara (JP); Kazuhiko Tsuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 210 days.

(21) Appl. No.: 09/975,874

(22) Filed: Oct. 12, 2001

(65) Prior Publication Data

US 2002/0089477 A1 Jul. 11, 2002

(30) Foreign Application Priority Data

Oct. 13, 2000 (JP) ..... P2000-313874
Sep. 13, 2001 (JP) ..... P2001-278441

(51) Int. Cl.[7] ..... G09G 3/36
(52) U.S. Cl. ..... 345/94; 345/87
(58) Field of Search ..... 345/60, 87, 94, 345/95, 98, 208

(56) References Cited

U.S. PATENT DOCUMENTS 6,414,318 B1 * 7/2002 Uber, III et al. ..... 250/389
6,570,549 B2 * 5/2003 Nakanishi et al. ..... 345/87
2002/0008686 A1 * 1/2002 Kumada et al. ..... 345/94

FOREIGN PATENT DOCUMENTS

JP 2064525 3/1990

OTHER PUBLICATIONS

"*Reflective Nematic LC Devices for LCOS Applications*", Minhua Lu, et al., IBM T.J. Watson Research Center, Yorktown Heights, NY 10598; ISSN1083–1312/00/2001–0001, pp. 1–7.

* cited by examiner

*Primary Examiner*—Kent Chang
*Assistant Examiner*—Tommy Sheng
(74) *Attorney, Agent, or Firm*—David G. Conlin; David A. Tucker; Edwards & Angell, LLP

(57) ABSTRACT

An object of the invention is to provide a liquid crystal display apparatus driving method capable of preventing display quality deterioration caused by action of DC voltage components exerted on a liquid crystal layer. Common electrode potential set at counter potential K5 for correcting a first DC voltage component ΔV1 ascribable to parasitic capacitance of TFT is shifted to correction potential K6 for correcting a second DC voltage component ΔV2 ascribable to characteristics of each substrate. Since the second DC voltage component ΔV2 ascribable to difference in characteristics between the substrates and the first DC voltage component ΔV1 ascribable to parasitic capacitance are corrected beforehand, the DC voltage component acting upon the liquid crystal layer is kept as small as possible, thereby preventing an image persistence or the like, so that the reliability of the liquid crystal display apparatus improves.

7 Claims, 10 Drawing Sheets

DISPLAY APPARATUS, DISPLAY APPARATUS DRIVING METHOD, AND LIQUID CRYSTAL DISPLAY APPARATUS DRIVING METHOD

BACKGROUND OF THE INVENTION

1. Field of the Invention

The present invention relates to a liquid crystal display apparatus driving method capable of preventing degradation in display quality of a liquid crystal display apparatus.

2. Description of the Related Art

A liquid crystal apparatus has power-consumption and portability advantages over other known image display apparatuses, and thus development in the liquid crystal apparatus field has been actively pursued. FIG. 11 is a timing chart of voltage waveforms, illustrating a prior art TFT liquid crystal display apparatus driving method. In the figure, Line L1 represents a waveform of a voltage applied to a pixel electrode; Line L2 represents a waveform of a scanning voltage inputted to a gate electrode; Line L3 represents a waveform of a display voltage inputted to a source electrode; Line L4 represents a reference potential, i.e. an intermediate potential of the display voltage; and Line L5 represents a counter potential of a common electrode.

When a positive gate-on voltage is applied to the gate electrode, the TFT is turned on, and thereby a display voltage is fed from the source electrode so as to be inputted via a drain electrode to the pixel electrode acting as a reflecting electrode. As a result, pixels are turned on. The TFT is kept in the ON state for a predetermined period of time, and, after a display voltage is applied to the pixel electrode, a gate-off voltage is applied to the gate electrode. Hereupon, the power supply to the pixel electrode is completed. The pixel electrode is, by exploiting the holding characteristics of the liquid crystal, maintained in a predetermined-voltage applied state until a gate-on voltage is applied once again to the TFT, i.e. over "gate-off" periods. When a gate-off voltage is applied to the gate electrode, due to subsequently-described parasitic capacitance Cgd, the voltage carried by the pixel electrode varies and takes a voltage variation value of ΔV1 calculated from the following formula:

$$\Delta V1=\Delta Vg\times\{Cgd/(Cgd+Clc+Ccs)\} \quad (1)$$

Note that, in the above formula (1), ΔV1 represents a value of voltage variation resulting from the parasitic capacitance; ΔVg represents the displacement amount of the potential of the gate voltage (gate-on voltage relative to gate-off voltage); Cgd represents static capacitance of the parasitic capacitance; Clc represents static capacitance of liquid crystal capacitance; and Ccs represents static capacitance of hoplding capacitance.

Such voltage variation as occurs in the pixel electrode leads to a DC voltage component, and this DC voltage component acts upon a liquid crystal layer. The action of the DC voltage component exerted on the liquid crystal layer causes the liquid crystal to exhibit polarization, which results in degradation in the reliability of the liquid crystal. As a result, the display surface suffers from an image persistence. Hereinafter, a DC voltage component resulting from voltage variation occurring in the pixel electrode is referred to as the first DC voltage component ΔV1.

To prevent the first DC voltage component ΔV1 from acting upon the liquid crystal layer, in the prior art, the circuit configuration of the liquid crystal display apparatus is designed such that the first DC voltage component ΔV1 calculated from the formula (1) is corrected beforehand. In other words, the potential of the common electrode to which a counter electrode is connected standing at the reference potential (i.e. the intermediate potential of the display voltage indicated by the line L4) level is shifted by an amount of the first DC voltage component ΔV1 in a negative potential direction so as to be initially set at the counter potential level indicated by Line L5.

Voltage variation resulting from the parasitic capacitance Cgd is possibly suppressed by adopting such a power source circuit configuration as shown in FIG. 12. In this case, Hi-voltage and Low-voltage are outputted in response to a control signal Vin at given intervals. When High-voltage is fed, a switch S is turned on, and thereby a voltage of a power source P1 is applied to a capacitor C. After a lapse of a predetermined period of time, Low-voltage is outputted in response to the control signal Vin, and thereby a GND (ground) potential is applied to the capacitor C. By applying to the capacitor C a power source voltage and a GND voltage at predetermined intervals, an alternating voltage is outputted from the capacitor C to the common electrode side (output signal: Vout). Then, a specific voltage is applied to the alternating voltage so that the voltage variation resulting from the parasitic capacitance Cgd of the capacitor C is corrected.

An application voltage refers to a voltage which is outputted from a power source P2 and is then fed toward a resistance R3 side through divided resistance, i.e. resistances R1 and R2. FIG. 13 shows a waveform of the output signal Vout. The waveform of the output signal Vout is formed as a composite waveform created by linking the waveform of the alternating voltage from the capacitor C and the waveform of the DC voltage from the power source P2. By applying a correction voltage to the common-electrode side in that way, the influence of the voltage variation resulting from the parasitic capacitance Cgd can be suppressed.

However, application of a correction voltage requires an additional power source, like the power source P2 shown in FIG. 12. In addition, a negative power source is required for correcting the alternating voltage of the common electrode. This leads to an undesirable increase of power consumption.

A DC voltage component acting upon the liquid crystal layer is caused not only by the above-described parasitic capacitance Cgd but also by asymmetricity in characteristics between an active matrix substrate and a counter substrate that have sandwiched therebetween the liquid crystal layer. A DC voltage component resulting from the asymmetricity between the active matrix substrate and the counter substrate acts upon the liquid crystal layer constantly. Hereinafter, a DC voltage component resulting from the difference in characteristics between the mutually-opposing substrates is referred to as the second DC voltage component ΔV2.

The asymmetricity in characteristics between the substrates includes: the difference in thickness between the active-matrix-substrate-side alignment film and the counter-substrate-side alignment film; the difference in material between the active-matrix-substrate-side alignment film and the counter-substrate-side alignment film (observed in the case of hybrid orientation); and the difference in material between two electrodes opposed to each other with a liquid crystal layer therebetween, like an Al-made active-matrix-substrate-side reflecting electrode and an ITO-made counter-substrate-side transparent electrode in a reflection-type liquid crystal display apparatus. Of these factors, in particular, the asymmetricity defined by the difference in material between electrodes opposed to each other with a liquid crystal layer therebetween causes the largest second DC voltage component ΔV2.

Moreover, the second DC voltage component ΔV2 resulting from the difference in material between the electrodes cannot be obtained by calculation. Therefore, it takes much time to adjust the potential of the common electrode properly, and, during the adjustment, the second DC voltage component ΔV2 continues to act upon the liquid crystal layer. This leads to degradation in the reliability of the liquid crystal display apparatus and causes problems such as occurrence of an image persistence.

Further, Japanese Unexamined Patent Publication JP-A 2-64525 (1990) discloses a technique for preventing occurrence of the second DC voltage component ΔV2 by making the active-matrix-substrate-side alignment film identical in material and thickness with the counter-substrate-side alignment film. However, the prior art technique disclosed in this publication failed to come up with satisfactory solutions to the above-described problem particularly encountered by a liquid crystal display apparatus which necessitates electrodes made of different materials, like a reflection-type liquid crystal display apparatus. Moreover, the publication makes no reference to a technique for solving the above-described problem and improving display quality for a case where an active matrix substrate differs in characteristics from a counter substrate.

SUMMARY OF THE INVENTION

Accordingly, an object of the invention is to provide a liquid crystal display apparatus driving method capable of preventing degradation in display quality due to occurrence of a DC voltage component.

The invention provides a method for driving a display apparatus, the display apparatus comprising:

a first substrate having a first electrode;

a second substrate having a second electrode, the second electrode being opposed to the first electrode; and a display medium layer whose display condition is changed in accordance with a voltage component applied between the first electrode and the second electrode, wherein a correction voltage is applied beforehand so as to correct the voltage component resulting from difference in characteristics between the first and second substrates.

According to the invention, a display apparatus comprises: a first and a second substrate mutually opposed; a first electrode provided in the first substrate; a second electrode provided in the second substrate; and a display medium layer interposed between the first and second substrates, wherein a correction voltage is applied beforehand so as to correct a voltage component, resulting from the difference in characteristics between the first and second substrates, which acts upon the display medium layer. With this construction, a voltage component resulting from the difference in characteristics between the substrates is cancelled out, thereby protecting the display medium layer against the voltage component. As a result, occurrence of troubles such as an image persistence is successfully prevented, so that the reliability of the display apparatus improves.

The invention further provides a display apparatus comprising:

a first substrate having a first electrode;

a second substrate having a second electrode, the second electrode being opposed to the first electrode; and a display medium layer whose display condition is changed in accordance with a voltage component applied between the first electrode and the second electrode, wherein a correction voltage is applied beforehand so as to correct the voltage component resulting from difference in characteristics between the first and second substrates.

According to the invention, a display apparatus comprises: a first and a second substrate mutually opposed; a first electrode provided in the first substrate; a second electrode provided in the second substrate; and a display medium layer interposed between the first and second substrates, wherein a correction voltage is applied before hand so as to correct a voltage component, resulting from the difference in characteristics between the first and second substrates, which acts upon the display medium layer. With this construction, a voltage component resulting from difference in characteristics between the substrates is cancelled out, thereby protecting the display medium layer against the voltage component. As a result, occurrence of troubles such as an image persistence is successfully prevented, so that the reliability of the display apparatus improves.

According to the invention, a voltage component resulting from the difference in characteristics between the substrates is corrected beforehand, and therefore the display medium layer is protected against the voltage component. As a result, occurrence of troubles such as an image persistence is successfully prevented, so that the reliability of the display apparatus improves.

In the invention, it is preferable that the first electrode is formed as a pixel electrode, and supply/cutoff of display voltages to the pixel electrode is controlled by a thin-film transistor, that the second electrode is formed as a counter electrode to which a common electrode is connected, and that a potential of the common electrode standing at a reference potential (i.e. an intermediate potential of the display voltages) level is shifted by an amount of a first DC voltage component ΔV1 resulting from voltage variation caused by a parasitic capacitance of the thin-film transistor so as to be set at a counter potential level, and the potential set at the counter potential is further shifted by an amount of a second DC voltage component ΔV2 resulting from the difference in characteristics between the substrates so as to be initially set at a correction potential level.

According to the invention, the potential of the common electrode is shifted by an amount of the first DC voltage component ΔV1 resulting from the parasitic capacitance of the thin-film transistor so as to be set at the counter potential level, and the potential set at the counter potential level is further shifted by an amount of the second DC voltage component ΔV2 resulting from the difference in characteristics between the substrates so as to be initially set at the correction potential level. This makes it possible to cancel out the second DC voltage component ΔV2 resulting from the difference in characteristics between the substrates (such as the difference in material and film thickness between their electrodes or alignment films) as well as the first DC voltage component ΔV1 resulting from voltage variation caused by parasitic capacitance. As a result, the DC voltage component acting upon the liquid crystal layer is kept as small as possible, and thus occurrence of troubles such as an image persistence is substantially prevented, so that the reliability of the liquid crystal display apparatus improves. Moreover, no additional power source is required and accordingly reduction in power consumption is achieved.

Moreover, according to the invention, it is possible to correct beforehand the second DC voltage component ΔV2 resulting from the difference in characteristics between the substrates as well as the first DC voltage component ΔV1 resulting from voltage variation caused by parasitic capacitance. Therefore, the DC voltage component acting upon the liquid crystal layer is kept as small as possible, and thus occurrence of troubles such as an image persistence is substantially prevented. As a result, the display quality and reliability of the liquid crystal display apparatus improve.

In the invention, it is preferable that a work function of the first electrode is set to be smaller than a work function of the second electrode.

According to the invention, since the work function of the first electrode is set to be smaller than that of the second electrode, a DC voltage component ascribable to the work functions of the electrode materials is minimized.

Moreover, according to the invention, a DC voltage component ascribable to the work functions of the electrode materials is minimized.

The invention still further provides a method for driving a liquid crystal display apparatus, the liquid crystal display apparatus comprising:

a first substrate having a first electrode;

a second substrate having a second electrode, the second electrode being opposed to the first electrode; and a liquid crystal layer interposed between the first substrate and the second substrate, wherein a correction voltage is applied beforehand so as to correct a DC voltage component, resulting from difference in characteristics between the first substrate and the second substrate, which acts upon the liquid crystal layer.

According to the invention, a liquid crystal display apparatus comprises: a first and a second substrate mutually opposed; a first electrode provided in the first substrate; a second electrode provided in the second substrate; and a liquid crystal layer interposed between the first and second substrates, wherein a correction voltage is applied beforehand so as to correct a DC voltage component, resulting from the difference in characteristics between the first and second substrates, which acts upon the liquid crystal layer. With this construction, a DC voltage component resulting from the difference in characteristics between the substrates is cancelled out, and thus the liquid crystal layer is protected against the DC voltage component. As a result, occurrence of troubles such as an image persistence is successfully prevented, so that the reliability of the liquid crystal display apparatus improves.

In the invention, it is preferable that the difference in characteristics between the substrates includes the difference in material between the pixel electrode and the counter electrode.

According to the invention, even in a liquid crystal display apparatus in which the first-substrate-side pixel electrode and the second-substrate-side counter electrode are made of different materials, like a reflection-type liquid crystal display apparatus, a DC voltage component is successfully cancelled out, so that the display quality improves.

Moreover, according to the invention, even in a liquid crystal display apparatus in which the first-substrate-side pixel electrode and the second-substrate-side counter electrode are made of different materials, like a reflection-type liquid crystal display apparatus, a DC voltage component is prevented from acting upon the liquid crystal layer, so that the display quality improves.

In the invention, it is preferable that the difference in characteristics between the substrates includes the difference in film thickness between the pixel electrode and the counter electrode.

According to the invention, even in a case where the pixel electrode differs in film thickness from the counter electrode, a DC voltage component is successfully cancelled out, so that the display quality improves.

Moreover, according to the invention, even in a case where the pixel electrode differs in film thickness from the counter electrode, a DC voltage component is prevented from acting upon the liquid crystal layer, so that the display quality improves.

In the invention, it is preferable that the first substrate has a first alignment film and the second substrate has a second alignment film, and that the difference in characteristics between the substrates includes the difference in material between the first alignment film and the second alignment film.

According to the invention, even in a case where the first-substrate-side first alignment film and the second-substrate-side second alignment film are made of different materials, a DC voltage component is successfully cancelled out, so that the display quality improves.

Moreover, according to the invention, even in a case where the first-substrate-side first alignment film and the second-substrate-side second alignment film are made of different materials, a DC voltage component is prevented from acting upon the liquid crystal layer, so that the display quality improves.

In the invention, it is preferable that the first substrate has a first alignment film and the second substrate has a second alignment film, and that the difference in characteristics between the substrates includes the difference in film thickness between the first alignment film and the second alignment film.

According to the invention, even in a case where the first-substrate-side first alignment film differs in thickness from the second-substrate-side second alignment film, a DC voltage component is successfully cancelled out, so that the display quality improves.

Moreover, according to the invention, even in a case where the first-substrate-side first alignment film differs in thickness from the second-substrate-side second alignment film, a DC voltage component is prevented from acting upon the liquid crystal layer, so that the display quality improves.

In the invention, it is preferable that the first electrode is formed as a pixel electrode and supply/cutoff of display voltages to the pixel electrode is controlled by a thin-film transistor; that the second electrode is formed as a counter electrode to which a common electrode is connected; and that a potential of the common electrode standing at a reference potential (i.e. an intermediate potential of the display voltages) level is shifted by an amount of a first DC voltage component ΔV1 resulting from voltage variation caused by the parasitic capacitance so as to be set at a counter potential level, and the potential set at the counter potential level is further shifted by an amount of a second DC voltage component ΔV2 resulting from the difference in characteristics between the substrates so as to be initially set at a correction potential level.

According to the invention, the potential of the common electrode is shifted by an amount of the first DC voltage component ΔV1 resulting from the parasitic capacitance of the thin-film transistor so as to be set at the counter potential level, and the potential set at the counter potential is further shifted by an amount of the second DC voltage component ΔV2 resulting from the difference in characteristics between the substrates so as to be initially set at the correction potential level. This makes it possible to cancel out the second DC voltage component ΔV2 resulting from the difference in characteristics between the substrates (such as the difference in material and thickness between their electrodes or alignment films), as well as the first DC voltage component ΔV1 resulting from voltage variation caused by the parasitic capacitance. Therefore, the DC voltage component acting upon the liquid crystal layer is kept as small as possible, and thus occurrence of troubles such as an image persistence is satisfactorily prevented, so that the display quality and reliability of the liquid crystal display apparatus improve.

In the invention, it is preferable that a work function of the first electrode is set to be smaller than a work function of the second electrode.

According to the invention, since the work function of the first electrode is made smaller than that of the second electrode, DC voltage components ascribable to the work functions of both electrodes are kept small.

In the invention, it is preferable that, in a case where the pixel electrode is a reflecting electrode and the counter electrode is a transparent electrode, the potential of the common electrode standing at the counter potential level is shifted by an amount of the second DC voltage component ΔV2 in a positive potential direction so as to be initially set at the correction potential level.

According to the invention, in a case where a reflecting electrode is used as the pixel electrode and a transparent electrode is used as the counter electrode, a positive second DC voltage component ΔV2 is generated in the liquid crystal layer. To cancel this out, the potential of the common electrode standing at the counter potential level is shifted in a positive potential direction to the correction potential level. In this way, the DC voltage component acting upon the liquid crystal layer is kept as small as possible, so that the display quality improves.

Moreover, according to the invention, in a case where a reflecting electrode is used as the pixel electrode, a positive second DC voltage component ΔV2 is generated. Thus, the potential of the common electrode standing at the counter potential level is shifted in a positive potential direction to the correction potential level. In this way, the DC voltage component acting upon the liquid crystal layer is kept as small as possible, so that the display quality improves.

In the invention, it is preferable that, in a case where the pixel electrode is a transparent electrode and the counter electrode is a reflecting electrode, the potential of the common electrode standing at the counter potential level is shifted by an amount of the second DC voltage component ΔV2 in a negative potential direction so as to be initially set at the correction potential level.

According to the invention, in a case where a transparent electrode is used for each of the pixel electrode and the counter electrode, a negative second DC voltage component ΔV2 is generated in the liquid crystal layer. To cancel this out, the potential of the common electrode standing at the counter potential level is shifted in a negative potential direction so as to be set at the correction potential level. In this way, the DC voltage component acting upon the liquid crystal layer is kept as small as possible, so that the display quality improves.

Moreover, according to the invention, in a case where a transparent electrode is used as the pixel electrode, a negative second DC voltage component ΔV2 is generated. Thus, the potential of the common electrode standing at the counter potential level is shifted in a negative potential direction so as to be set at the correction potential level. In this way, the DC voltage component acting upon the liquid crystal layer is kept as small as possible, so that the display quality improves.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
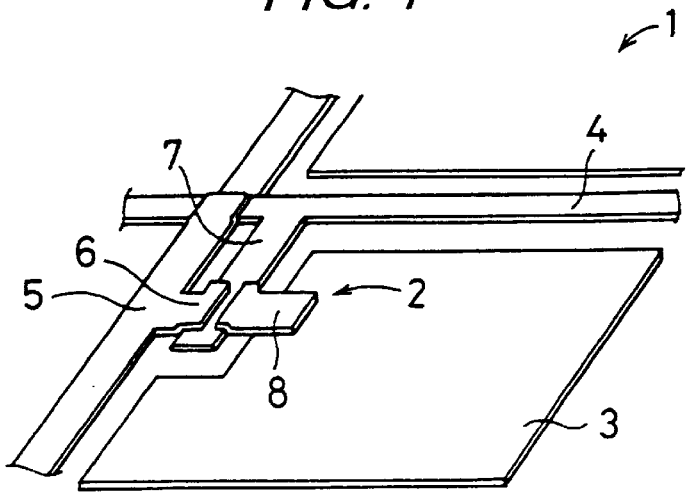
FIG. 1 is a perspective view illustrating a single pixel portion of a TFT liquid crystal display apparatus 1.

Now referring to the drawings, preferred embodiments of the invention are described below.

Figure 2:
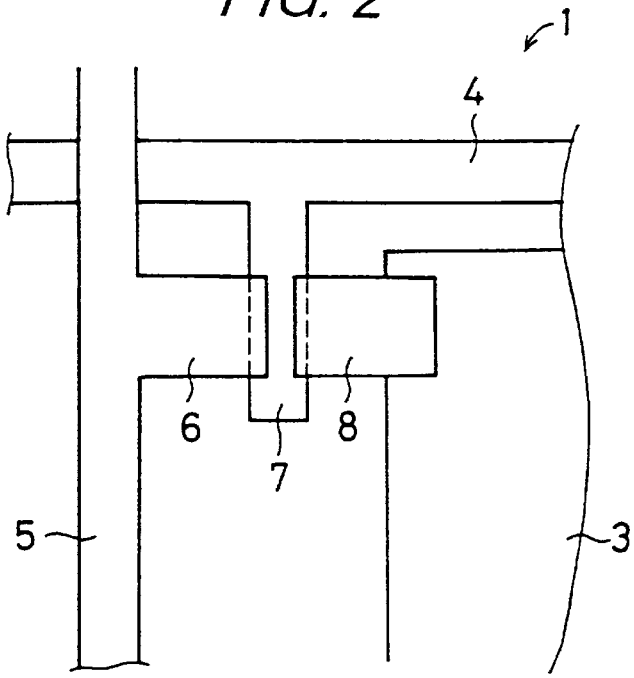
FIG. 2 is a plan view illustrating a single pixel portion of the TFT liquid crystal display apparatus 1.
Figure 3:
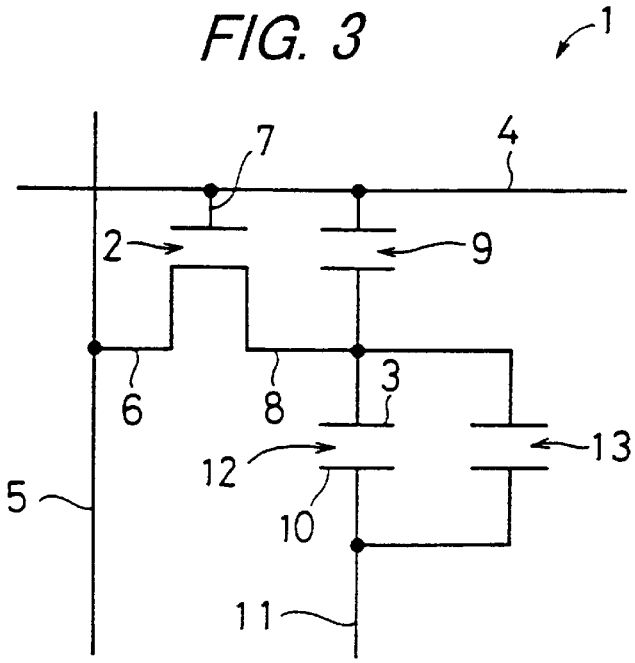
FIG. 3 is a circuit diagram of the TFT liquid crystal display apparatus 1.
Figure 4:
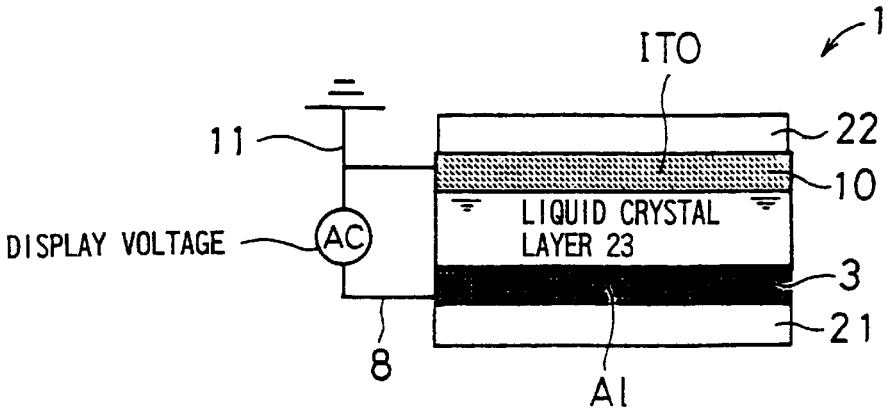
FIG. 4 is a schematic view of the liquid crystal display apparatus 1 in which a reflecting electrode is used as a pixel electrode 3 connected to a drain electrode 8 and a transparent electrode is used as a counter electrode 10 connected to a common electrode 11.

FIG. 1 is a perspective view illustrating one pixel portion of a reflection-type TFT liquid crystal display apparatus 1; FIG. 2 is a plan view illustrating one pixel portion of the reflection-type TFT liquid crystal display apparatus 1; FIG. 3 is a circuit diagram of the reflection-type TFT liquid crystal display apparatus 1; and FIG. 4 is a schematic view of the reflection-type TFT liquid crystal display apparatus 1.

The reflection-type TFT liquid crystal display apparatus 1 is composed of: an active matrix substrate 21 serving as a first substrate; a counter substrate 22 serving as a second substrate, the counter substrate being opposed to the active matrix substrate 21; and a liquid crystal layer 23 interposed between the active matrix substrate 21 and the counter substrate 22.

The active matrix substrate 21 includes: a pixel electrode 3, serving as a first electrode, which is a reflecting electrode made of Al; a gate bus line 4 for supplying gate voltages to a switching element of each pixel so that the pixels are turned on or off; a source bus line 5 for providing display voltages so that the pixels are turned on; and a thin-film transistor (hereafter abbreviated as "TFT") 2 which is a switching element for supplying power only to the pixel electrode 3 selected. Provided on the counter substrate 22 is a counter electrode 10, serving as a second electrode, which is an ITO (Indium Tin Oxide)-made transparent electrode opposed to the pixel electrode 3. Connected to the counter electrode 10 is a common electrode 11. Moreover, the TFT liquid crystal display apparatus 1 includes holding capacitance 13 having its one end connected to a TFT 2 and having its other end connected to the common electrode 11. The TFT liquid crystal display apparatus 1 also includes a first alignment film provided on the active-matrix-substrate 21 side and a second alignment film provided on the counter-substrate 22 side. Note that the pixel electrode 3 and the counter electrode 10 constitute liquid crystal capacitance 12. The liquid crystal layer 23 is formed as a display medium layer in which the orientation of the liquid crystal molecular acting as a display medium varies in accordance with a voltage component applied between the pixel electrode 3 and the counter electrode 10, whereby the display condition, i.e. light transmission or shielding condition, is changed. Note that the display medium layer is not limited to a liquid crystal layer, but may be of any other layer so long as it is capable of displaying an image by exploiting electrooptic changes which occur in the display medium of the layer when a voltage is applied between the electrodes having sandwiched the display medium layer therebetween.

Figure 5:
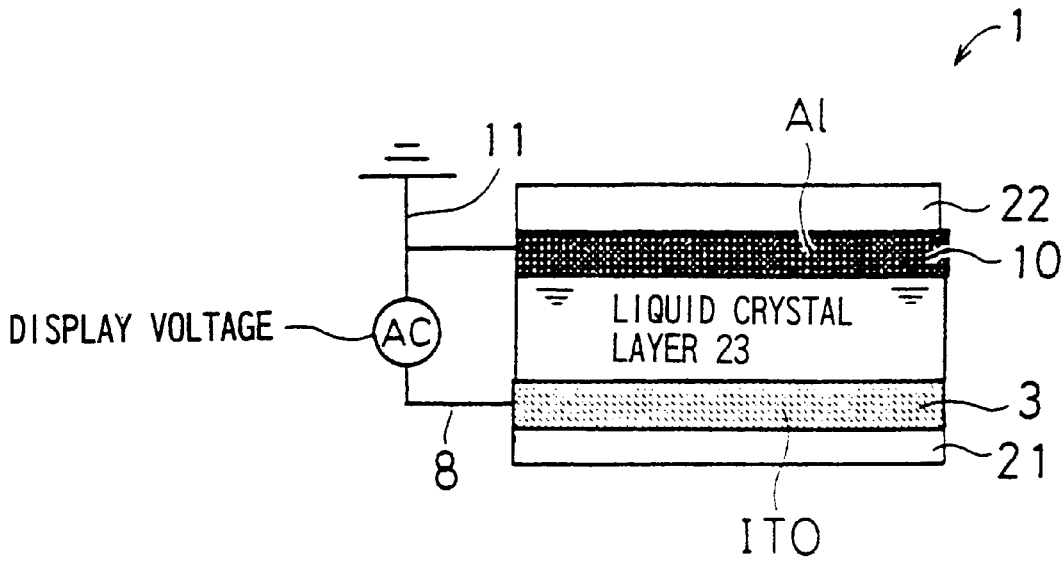
FIG. 5 is a schematic view of the liquid crystal display apparatus 1 in which a transparent electrode is used as the pixel electrode 3 connected to the drain electrode 8 and a reflecting electrode is used as the counter electrode 10 connected to the common electrode 11.

Moreover, it is possible to adopt the configuration shown in FIG. 5 in which an Al-made reflecting electrode is used as the counter electrode 10 connected to the common electrode 11, and an ITO-made transparent electrode is used as the pixel electrode 3 connected to a drain electrode 8.

The TFT 2 is composed of: a source electrode 6 connected to the source bus line 5; the drain electrode 8 connected to the pixel electrode 3; and a gate electrode 7, connected to the gate bus line 4, to which scanning voltages are inputted for performing switching between the source electrode 6 and the drain electrode 8. By superimposing part of the gate electrode 7 and part of the drain electrode 8 on one another, parasitic capacitance 9 is formed.

Figure 6:
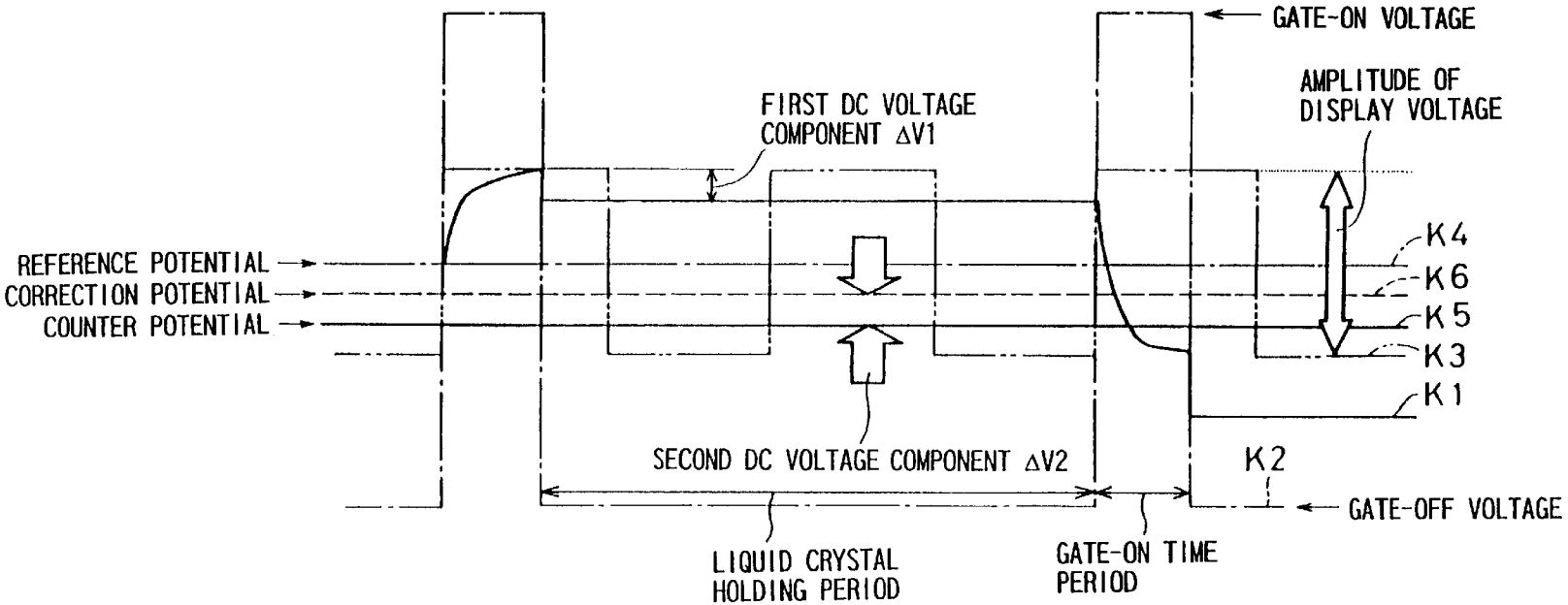
FIG. 6 is a timing chart of voltage waveforms, illustrating a method for driving the TFT liquid crystal display apparatus 1 in which a reflecting electrode is used as the pixel electrode 3 connected to the drain electrode 8 and a transparent electrode is used as the counter electrode 10 connected to the common electrode 11.

FIG. 6 is a timing chart of voltage waveforms, illustrating one embodiment of the reflection-type TFT liquid crystal display apparatus 1 driving method of the invention. In the figure, Line K1 represents a waveform of a voltage inputted to the pixel electrode 3; Line K2 represents a waveform of a scanning voltage inputted to the gate electrode 7; Line K3 represents a waveform of a display voltage inputted to the source electrode 6; Line K4 represents a reference potential, i.e. a central potential of the display voltage; Line K5 represents a counter potential of the common electrode 11, as obtained when a DC voltage component resulting from voltage variation caused by the parasitic capacitance 9 is corrected; and Line K6 represents a correction potential of the common electrode 11, as obtained when a DC voltage component resulting from the difference in characteristics between the substrates 21 and 22 and acting upon the liquid crystal layer 23 is corrected.

Hereinafter, a DC voltage component resulting from voltage variation due to the parasitic capacitance 9 is referred to as the first DC voltage component ΔV1, and a DC voltage component resulting from the difference in characteristics between the substrates 21 and 22 is referred to as the second DC voltage component ΔV2.

When a positive gate-on voltage is applied to the gate electrode 7, the TFT 2 is turned on, and thereby a display voltage is fed from the source electrode 6 so as to be inputted via the drain electrode 8 to the pixel electrode 3. Consequently, pixels are turned on. The TFT 2 is kept in the ON state for a predetermined period of time. Then, after a display voltage is carried by the pixel electrode, a gate-off voltage is applied to the gate electrode 7. Hereupon, the power supply to the pixel electrode 3 is completed. The pixel electrode 3 is, by exploiting the holding characteristics of the liquid crystal, maintained in a predetermined-voltage applied state until a gate-on voltage is applied once again to the TFT 2, i.e. over "gate-off periods". When a gate-off voltage is applied to the gate electrode 7, the above-described parasitic capacitance Cgd causes the held voltage carried by the liquid crystal capacitance 12 to drop. As a result, the liquid crystal layer 23 is acted upon by the first DC voltage component ΔV1.

Note that, in this specification, a positive potential direction is defined as a direction in which a voltage level is increased with respect to the reference potential, and a negative potential direction is defined as a direction in which a voltage level is decreased with respect to the reference potential.

Note that the first DC voltage component ΔV1 resulting from the parasitic capacitance 9 can be obtained beforehand by calculation based on the following formula:

$$\Delta V1=\Delta Vg\times\{Cgd/(Cgd+Clc+Ccs)\} \quad (1)$$

Note that, in the above formula (1), ΔV1 represents the first DC voltage component resulting from voltage variation due to the parasitic capacitance 9; ΔVg represents a displacement amount of scanning signal potentials (gate-on voltage relative to gate-off voltage); Cgd represents static capacitance for the parasitic capacitance 9; Clc represents static capacitance for the liquid crystal capacitance 12; and Ccs represents static capacitance for the holding capacitance 13.

Moreover, the liquid crystal layer 23 is acted upon by the second DC voltage component ΔV2 resulting from the difference in characteristics between the active matrix substrate 21 and the counter substrate 22. Note that the difference in characteristics between the substrates includes: the difference in material between the pixel electrode 3 and the counter electrode 10; the difference in film thickness between the pixel electrode 3 and the counter electrode 10; the difference in material between the active-matrix-substrate-side first alignment film and the counter-substrate-side second alignment film; and the difference in thickness between the first alignment film and the second alignment film.

Note that, as shown in FIG. 6, in a case where a reflecting electrode is used as the pixel electrode 3 connected to the drain electrode 8 of the TFT 2, and a transparent electrode is used as the counter electrode 10 connected to the common electrode 11, the liquid crystal layer 23 is acted upon by a positive second DC voltage component ΔV2.

Figure 7:
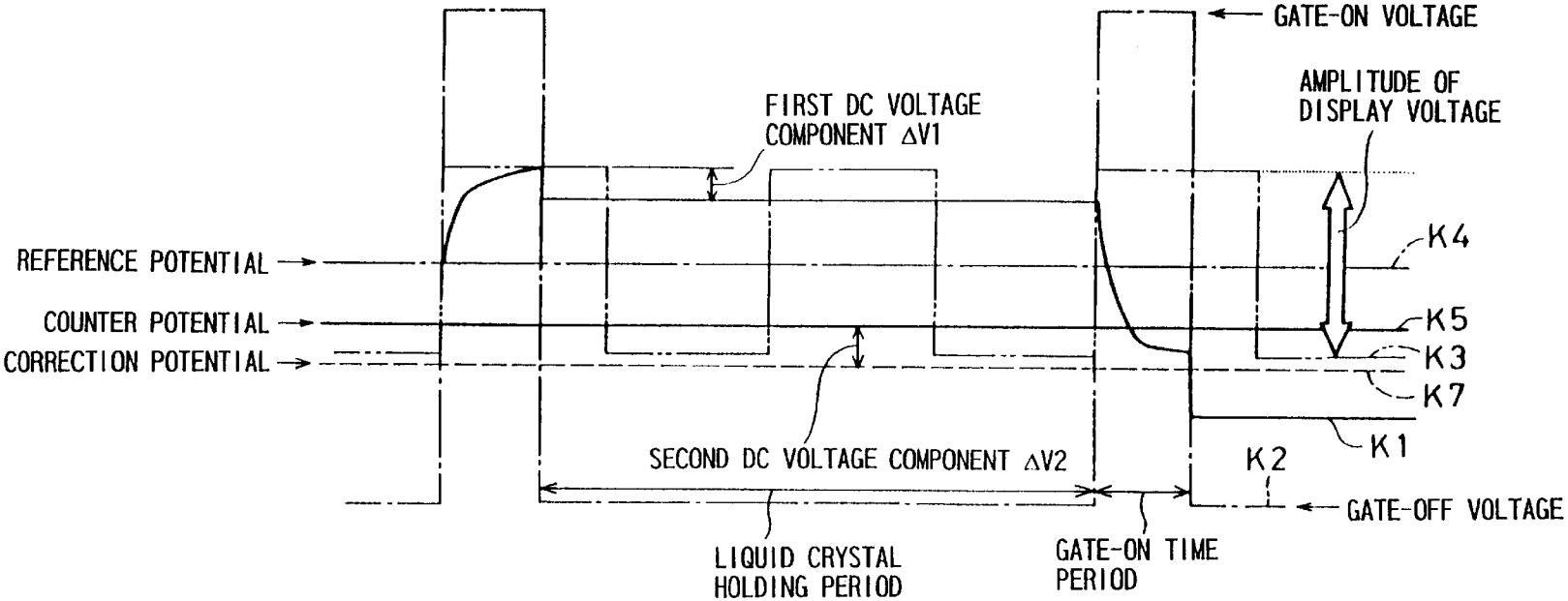
FIG. 7 is a timing chart of voltage waveforms, illustrating a method for driving the liquid crystal display apparatus 1 in which a transparent electrode is used as the pixel electrode 3 connected to the drain electrode 8 and a reflecting electrode is used as the counter electrode 10 connected to the common electrode 11.

Moreover, as shown in FIG. 7, in a case where a reflecting electrode is used as the counter electrode 10 connected to the common electrode 11, and a transparent electrode is used as the pixel electrode 3 connected to the drain electrode 8 of the TFT 2, the liquid crystal layer 23 is acted upon by a negative second DC voltage component ΔV2.

The action of the first and second DC voltage components exerted on the liquid crystal layer 23 causes the liquid crystal to exhibit polarization, which results in degradation in the reliability of the liquid crystal. As a consequence, the display surface suffers from an image persistence.

Thus, in the liquid crystal display apparatus driving method according to the embodiment, the circuit configuration of the liquid crystal display apparatus 1 is designed such that the second DC voltage component ΔV2 is shifted from the counter potential level so as to be corrected beforehand.

More specifically, the potential of the common electrode 11 standing at the reference potential (i.e. the intermediate potential of the amplitude of the display signal) level is shifted to the counter potential so that the first DC voltage component ΔV1 resulting from the parasitic capacitance 9 is corrected, and the potential set at the counter potential is further shifted by an amount of the second DC voltage component ΔV2 so as to be set at the correction potential level.

In other words, as shown in FIG. 4, in a case where a reflecting electrode is used as the pixel electrode 3 connected to the drain electrode 8, and a transparent electrode is used as the counter electrode 10, the potential of the common electrode 11 standing at the reference potential level indicated by Line K4 is shifted by an amount of the first DC voltage component ΔV1 in the negative potential direction (toward the lower part of FIG. 6) so as to be set at the counter potential level indicated by Line K5, and, the potential set at the counter potential is further shifted by an amount of the second DC voltage component ΔV2 in the positive potential direction (toward the upper part of FIG. 6) so as to be initially set at the correction potential level indicated by Line K6.

Moreover, as shown in FIG. 5, in a case where a transparent electrode is used as the pixel electrode 3 connected to the drain electrode 8, and a reflecting electrode is used as the counter electrode 10, the potential of the common electrode 11 standing at the reference potential level indicated by Line K4 is shifted by an amount of the first DC voltage component ΔV1 in the negative potential direction (toward the lower part of FIG. 7) so as to be set at the counter potential level indicated by Line K5, and the potential set at the counter potential is further shifted by an amount of the second DC voltage component ΔV2 in the negative potential direction (toward the lower part of FIG. 7) so as to be initially set at the correction potential level indicated by Line K7.

Thus, in the liquid crystal display apparatus driving method according to the embodiment, it is possible to correct beforehand not only the first DC voltage component ΔV1 resulting from voltage variation due to the parasitic capacitance 9, but also the second DC voltage component ΔV2 resulting from the difference in characteristics between the substrates. Therefore, during the operation of the liquid crystal display apparatus 1, the DC voltage component acting upon the liquid crystal layer 23 is kept as small as possible. As a result, occurrence of troubles such as an image persistence is satisfactorily prevented, so that the display quality and reliability of the liquid crystal display apparatus 1 improve.

Figure 8:
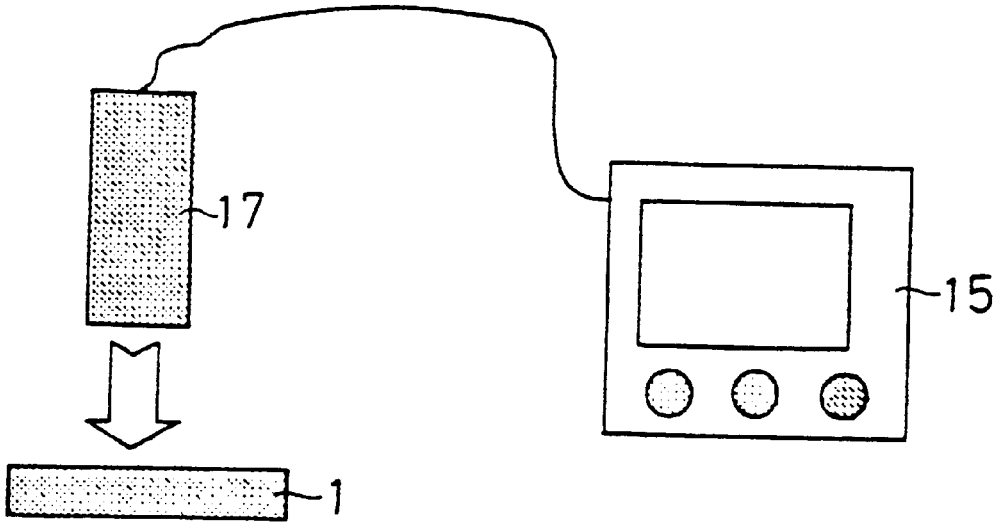
FIG. 8 is a view illustrating a setting system for setting a potential of the common electrode 11 to a correction potential.

Next, a description will be given below as to a method for setting the potential of the common electrode 11 to the correction potential level for correcting the first and second DC voltage components ΔV1 and ΔV2. FIG. 8 is a view showing a setting system for setting the potential of the common electrode 11 to the correction potential level. The setting system is composed of a brightness variation observer 15 and a brightness variation detector 17. With use of this setting system, the potential of the common electrode 11 is so set that an execution value for a case where a positive-going voltage is applied to the liquid crystal layer 23 is identical in area (range) with an execution value for a case where a negative-going voltage is applied thereto. Specifically, because of the asymmetricity between the execution value for application of a positive-going voltage and that for application of a negative-going voltage, a flicker phenomenon (one of changes in optical characteristics) occurs. Upon detecting such a flicker, the potential of the common electrode 11 is so set that the detected flicker is reduced to a minimum.

More specifically, a flicker occurring in the liquid crystal display apparatus 1 is quantitatively detected by the brightness variation detector 17, such as a photomultimater, and the brightness is converted into a voltage by a brightness/voltage converter. Thereafter, with reference to the brightness variation observer 15, the potential of the common electrode 11 is so set that the detected voltage is adjusted to have the minimum amplitude.

Moreover, in a display apparatus in which electrodes of its upper and lower substrates are made of different materials, typified by a reflection-type liquid crystal display apparatus, the second DC voltage component ΔV2 can be corrected by taking materials connected to the electrodes into consideration.

In a case where a display voltage of the pixel electrode is controlled by a thin-film transistor, the work function $\phi$ 1 of the pixel electrode material is set to be smaller than the work function $\phi$ 2 of the counter electrode material. This makes it possible to correct the first DC voltage component ΔV1 by the second DC voltage component ΔV2 resulting from the difference in work function between the electrode materials. Even though the electrodes are made of identical materials, if alignment films formed on their surfaces are made differently, work function difference occurs. When atoms having a dipole, like an alignment film, adhere to a metal surface, double electric layers are formed on the metal surface, with the result that the work function varies. That is, the alignment film formed on the surface of the electrode metal causes variation in energy required to remove a single electron from the Fermi level of solid metal and move it to the immediate neighborhood of the outside of the surface. For example, even though the electrodes are made of identical materials, if their alignment films are different in thickness and material from each other, the energy varies, with the result that the work function of the entire electrode material including the alignment film varies. Note that such characteristics are not only true of an alignment film, but also for a case where on an electrode metal surface is formed a film or layer to which atoms having a dipole adheres.

PRACTICAL EXAMPLE 1

Transmission- and reflection-type liquid crystal display apparatuses having such configuration as shown in Table 1 were fabricated by the inventor concerned to evaluate voltage variation. The test results will be described hereinbelow. With use of the above-described system, the degrees of the deviation of the reference potential with respect to the counter potential for correcting the first voltage component ΔV1 resulting from the parasitic capacitance 9 and the deviation of the counter potential with respect to the correction potential for correcting the second DC voltage component ΔV2 resulting from the difference in characteristics between the substrates were measured.

TABLE 1

| | First alignment film material | Second alignment film material | Pixel electrode thickness | Counter electrode thickness | Second DC voltage component ΔV2 |
|---|---|---|---|---|---|
| First transmission liquid crystal display apparatus | A | A | 800 Å | 800 Å | +20 mV |
| Second transmission liquid crystal display apparatus | A | B | 800 Å | 800 Å | +100 mV |
| Third transmission liquid crystal display apparatus | A | A | 400 Å | 800 Å | +500 mV |
| Reflection liquid crystal display apparatus | A | A | 800 Å | 800 Å | +800 mV |

Note that the specific values of the second DC voltage component ΔV2 shown in Table 1 are merely examples for the sake of easy explanation. That is, the polarity (positive or negative) and the numeric value associated with the second DC voltage component ΔV2 vary depending upon combinations of the above conditions.
Note that, in the transmission-type liquid crystal display apparatuses shown in Table 1, ITO is used to realize the pixel electrode 3 and the counter electrode 10. On the other hand, in the reflection-type liquid crystal display apparatus shown in Table 1, an Al electrode (a reflecting electrode) is used as the pixel electrode 3 and ITO (a transparent electrode) is used as the counter electrode 10 opposed to the pixel electrode 3.

As seen from Table 1, in the transmission-type liquid crystal display apparatus in which the active-matrix-substrate 21-side first alignment film is identical in material and thickness with the counter-substrate 22-side second alignment film, that is, the held voltage is varied solely due to the parasitic capacitance 9 of the TFT 2, the deviation between the correction potential and the counter potential, i.e. the second DC voltage component ΔV2, was found to be about 20 mV. By contrast, in the reflection-type liquid crystal display apparatus in which the active-matrix-substrate 21-side first alignment film is identical in material and thickness with the counter-substrate 22-side second alignment film, but the pixel electrode 3 and the counter electrode 10 are made of different materials, the deviation between the correction potential and the counter potential, i.e. the second DC voltage component ΔV2, was found to be as great as about 800 mV. From these facts, it will be understood that the difference in material between the pixel electrode 3 and the counter electrode 10 is responsible for occurrence of the second DC voltage component ΔV2.

More specifically, as seen from Table 2, in the case where an Al electrode is used as the pixel electrode 3 connected to the drain electrode 8 and an ITO electrode is used as the counter electrode 10 connected to the common electrode 11, the correction potential of the common electrode 11 deviates by about 800 mV in the positive potential direction from the counter potential. That is, the liquid crystal layer 23 is acted upon by the second DC voltage component ΔV2 of 800 mV.

Moreover, in the case where an ITO electrode is used as the pixel electrode 3 connected to the common electrode 11 and a reflecting electrode is used as the counter electrode 10 connected to the drain electrode 8, the correction potential of the common electrode 11 deviates by about 800 mV in the negative potential direction from the counter potential. That is, the liquid crystal layer 23 is acted upon by the second DC voltage component ΔV2 of −800 mV.

TABLE 2

| | Reflecting electrode | Transparent electrode | Second DC voltage component ΔV2 |
|---|---|---|---|
| Reflection-type liquid crystal display apparatus | Drain electrode | Common electrode | +800 mV |
| | Common electrode | Drain electrode | −800 mV |

Accordingly, in the reflection-type liquid crystal display apparatus driven by the liquid crystal display apparatus driving method according to the embodiment, as shown in FIG. 6, where an Al electrode is used as the pixel electrode 3 connected to the drain electrode 8, the potential of the common electrode 11 standing at the counter potential K5 level is shifted by an amount of the second DC voltage component ΔV2 (=about 800 mV) in the positive potential direction so as to be initially set at the correction counter potential K6 level.

Moreover, as shown in FIG. 7, in the case where an ITO electrode is used as the pixel electrode 3 connected to the drain electrode 8, the potential of the common electrode 11 standing at the counter potential level is shifted by an amount of the second DC voltage component ΔV2 (=about 800 mV) in the negative potential direction so as to be set at the correction potential K7 level.

Thus, when the potential of the common electrode 11 needs to be adjusted with accuracy using the above-described setting system, by initially setting the potential of the common electrode 11 at the correction potential K6 or K7 in that way, the adjustment operation becomes simply a matter of fine adjustment of the potential and is thus achieved in a short period of time. Further, during the adjustment, it never occurs that the liquid crystal layer 23 is acted upon by the second DC voltage component ΔV2. As a result, satisfactory reliability can be attained.

Note that, although the embodiment in question deals with the case where Al (aluminum) is used as a material for the reflecting electrode, the reflecting electrode may be made of other materials such as silver, copper, nickel, or chromium so long as it differs in material from the transparent electrode. Also in this case, satisfactory reliability can be attained by initially setting the potential of the common electrode 11 at the correction potential level.

PRACTICAL EXAMPLE 2

As for Practical example 1 described just above, explanation is given as to correction of the second DC voltage component ΔV2 resulting from the difference in material between the pixel electrode 3 and the counter electrode 10. However, the deviation between the correction potential and the counter potential in the common electrode 11, i.e. the second DC voltage component ΔV2, occurs not only in a case where the electrodes are made of different materials, but also in a case where, as in the second transmission-type liquid crystal display apparatus shown in Table 1, while the pixel electrode 3 and the counter electrode 10 are made of identical materials, the active-matrix-substrate 21-side first alignment film and the counter-substrate 22-side second alignment film are made of different materials. The resultant second DC voltage component ΔV2 acts upon the liquid crystal layer 23. In a case where, as in the second transmission-type liquid crystal display apparatus, soluble polyimide A is used for the first alignment film and soluble polyimide B is used for the second alignment film, the correction potential deviates by about 500 mV from the counter potential.

Moreover, even if the alignment films are made of identical materials, similar deviation might occur if the material in use is characterized in that, when it is partly irradiated with ultraviolet light or the like, the light-irradiated portion, which is originally vertically oriented, is horizontally oriented. That is, ultraviolet-light irradiation causes the configuration of the vertical alignment film to change, which results in similar deviation.

Accordingly, in the transmission-type liquid crystal display apparatus driven by the liquid crystal display apparatus driving method according to the embodiment, after being shifted to the counter potential level for correcting the first DC voltage component ΔV1 calculated from the formula (1), the potential of the common electrode 11 is further shifted to the correction potential level for correcting the second DC voltage component ΔV2. In other words, the potential of the common electrode 11 standing at the counter potential K5 level is shifted in the positive potential direction (toward the upper part of FIG. 6) so as to be initially set at the correction potential K6 level. By doing so, when the potential of the common electrode 11 needs to be adjusted with accuracy using the above-described setting system, the adjustment operation becomes simply a matter of fine adjustment of the potential and is thus achieved in a short period of time. Further, during the adjustment, it never occurs that the liquid crystal layer 23 is acted upon by the second DC voltage component ΔV2. As a result, satisfactory reliability can be attained.

PRACTICAL EXAMPLE 3

For Practical example 2 described just above, explanation is given as to correction of voltage variation resulting from the difference in material between the active-matrix-substrate-21-side first alignment film and the counter-substrate 22-side second alignment film.

However, even though the first and second alignment films are made of identical materials, if, as in the third transmission-type liquid crystal display apparatus shown in Table 1, the first and second alignment films differ in thickness from each other, the correction potential deviates with respect to the counter potential for correcting only the first DC voltage component ΔV1 calculated from the formula (1).

That is, as shown in Table 1, in the second transmission-type liquid crystal display apparatus in which the first alignment film has a thickness of about 400 Å and the second alignment film has a thickness of about 800 Å, the correction potential was measured and found to deviate by about 100 mV from the counter potential for correcting the first DC voltage component ΔV1. This means that the liquid crystal layer 23 is acted upon by the second DC voltage component ΔV2.

Accordingly, in the transmission-type liquid crystal display apparatus driven by the liquid crystal display apparatus driving method according to the embodiment, the potential of the common electrode 11 standing at the counter potential K5 level for correcting the first DC voltage component ΔV1 calculated from the formula (1) is shifted by an amount of the second DC voltage component ΔV2 (=100 mV) in the positive potential direction so as to be initially set at the correction potential K6 level. By initially setting the potential of the common electrode 11 to the correction potential level, when the potential of the common electrode 11 needs to be adjusted with accuracy using the above-described setting system, the adjustment operation becomes simply a matter of fine adjustment of the potential and is thus achieved in a short period of time. Further, during the adjustment, it never occurs that the liquid crystal layer 23 is acted upon by the second DC voltage component ΔV2. As a result, satisfactory reliability can-be attained.

PRACTICAL EXAMPLE 4

Figure 9B:
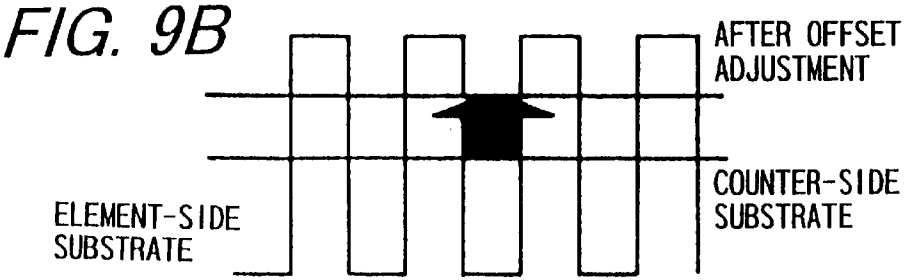
FIGS. 9A to 9C includes a schematic view of the liquid crystal display apparatus and views illustrating voltage waveforms.
Figure 9C:
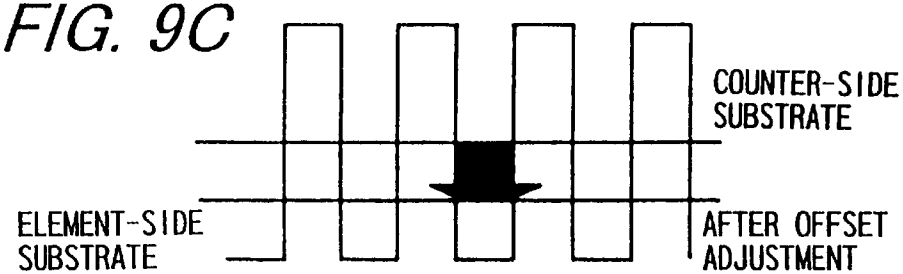
Figure 9A:
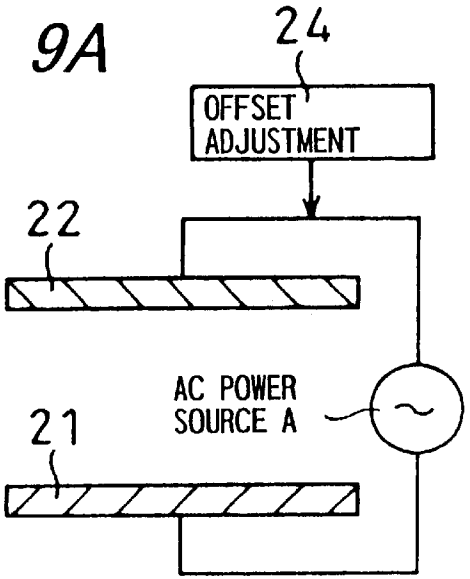

FIGS. 9A to 9C includes a schematic view of the liquid crystal display apparatus and views illustrating voltage waveforms. As shown in FIG. 9A, by an AC power source A, a voltage is applied between the active matrix substrate 21 having a TFT formed thereon and the counter substrate 22. In a case where an Al-made reflecting electrode is formed on the active matrix substrate 21 and an ITO-made transparent electrode is formed on the counter substrate 22, the Al electrode has a potential higher than that of the ITO electrode. Adjustment for compensating for this potential difference is carried out on the side of the counter substrate in the following manner. As shown in FIG. 9B, with use of an offset adjuster 24, a counter-substrate-side voltage is shifted in the positive potential direction relative to an active-matrix-substrate-side voltage. Moreover, in a case where an ITO electrode is formed on the active matrix substrate 21 and an Al electrode is formed on the counter substrate 22, as shown in FIG. 9C, the counter-substrate-side voltage is shifted in the negative potential direction relative to the active-matrix-substrate-side voltage.

Figure 10B:
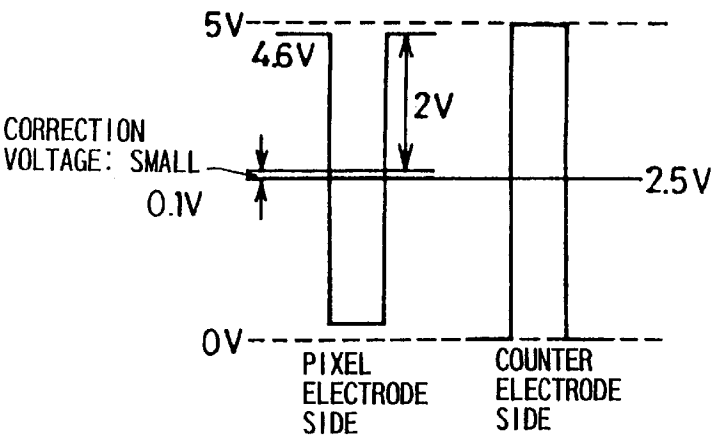
FIGS. 10A and 10B are views illustrating variation in voltage waveforms.
Figure 10A:
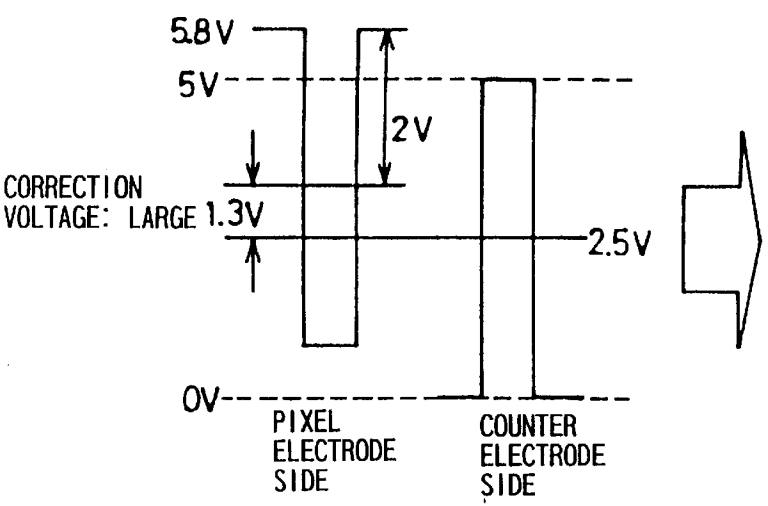
Figure 11:
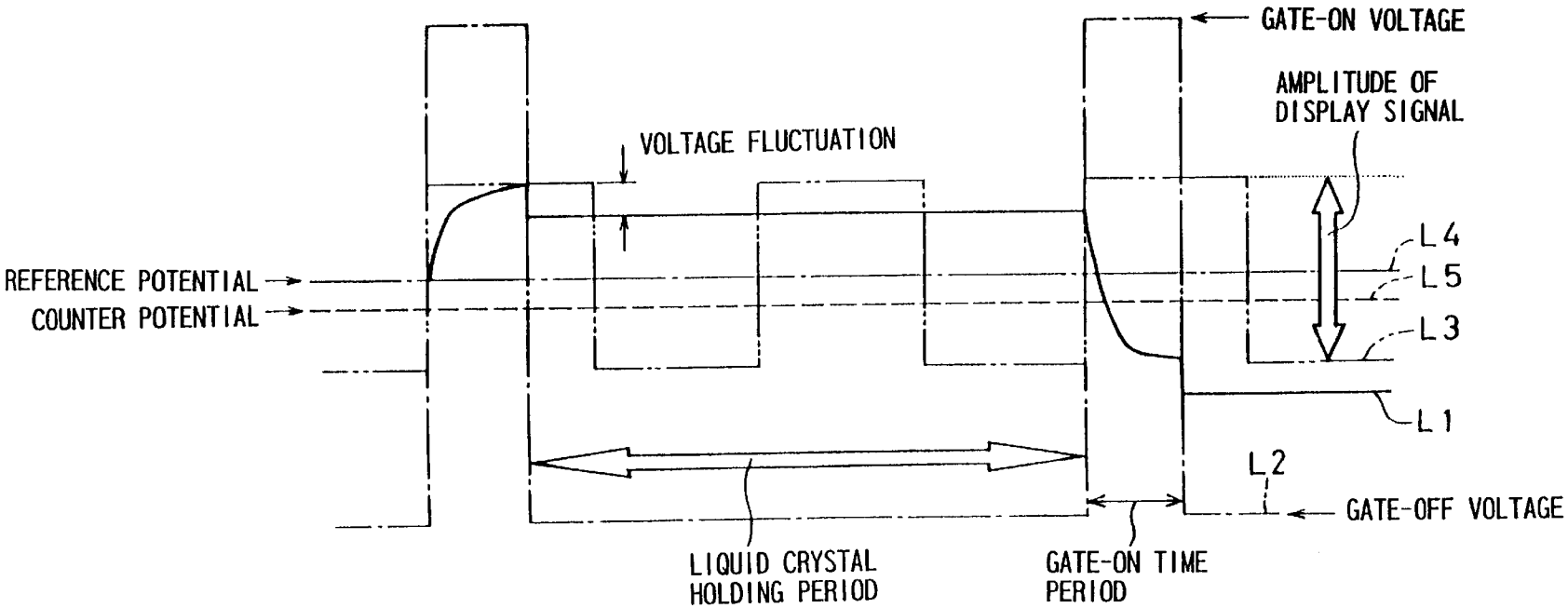
FIG. 11 PRIOR ART
FIG. 11 is a timing chart of voltage waveforms, illustrating a method for driving a prior art TFT liquid crystal display apparatus.
Figure 12:
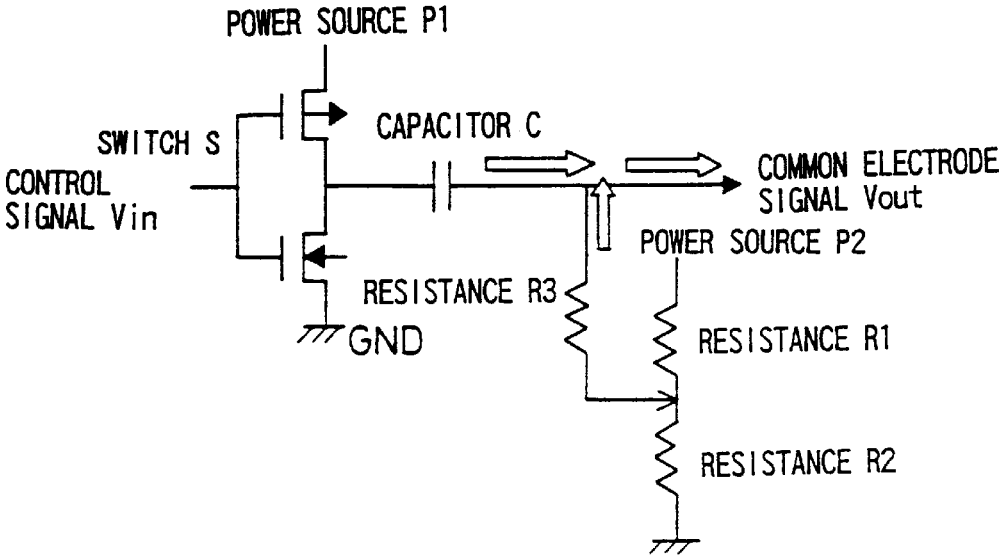
FIG. 12 PRIOR ART
FIG. 12 is a view illustrating a circuit configuration of a power source unit.
Figure 13:
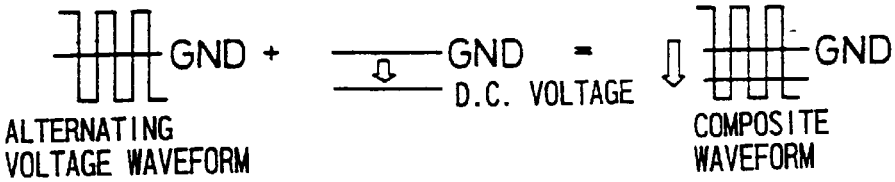
FIG. 13 PRIOR ART
FIG. 13 is a view illustrating a waveform of an output signal Vout.

As described heretofore, by providing an Al electrode in the active matrix substrate 21 and providing an ITO electrode in the counter substrate 22, it is possible to cancel out voltage variation resulting from the parasitic capacitance Cdg. This is achieved by taking work functions of electrode materials into consideration, i.e. by making the work function $\phi$ 1 of the material used for the electrode formed on the active matrix substrate 21 smaller than the work function $\phi$ 2 of the material used for the electrode formed on the counter substrate 22. FIGS. 10A and 10B are views illustrating variation in voltage waveforms. Conventionally, as shown in FIG. 10A, since the correction voltage is relatively large, a negative power source is required to generate alternating waveforms on the counter electrode side. However, as shown in FIG. 10B, by setting the work functions to the desired level, the correction voltage is decreased, thereby eliminating the need to employ an additional power source such as a negative power source. This contributes to reduction in power consumption.

Further, a detailed explanation will be given below. A reflection-type TFT liquid crystal display apparatus was actually manufactured to examine the effects of the invention. Here, Al was used as the material of the electrode provided in the active matrix substrate, and ITO was used as the material of the electrode provided in the counter substrate. Assuming that a gate-on voltage is +15V and a gate-off voltage is −10V, then voltage variation resulting from the parasitic capacitance Cgd was found to reach the degree of 0.7 V, and the voltage of the Al and ITO on the basis of the difference in work function was found to be 0.6 V. Moreover, during black color display, a voltage to be applied to the liquid crystal was set at 4.5 V, and the signals of the counter-substrate-side common electrode were given rectangular waves of 0 to 5 V.

In consideration of voltage variation caused by Cgd and the voltage of Al and ITO on the basis of their work functions, a 0.1 V correction was required. At that time, the value of Hi-voltage of the source signal was found to be 4.6V, and therefore the operation was achieved adequately only with a 5V power source. This led to reduction in the number of power sources and thus power consumption.

On the other hand, in the case where ITO was used as the material of the active-matrix-substrate-side electrode, and Al was used as the material of the counter-substrate-side electrode, a 1.3 V correction was required. At that time, the value of Hi-voltage of the source signal was found to be 5.8V, and therefore the 5 V power source failed to serve for adequate operation. In addition, the correction voltage was reduced to a minimum, and this eliminates the need to provide an additional power source for correcting power source voltages.

Note that, in the above explanation, the invention is described as applied to a liquid crystal display apparatus although other display apparatuses are contemplated, such as an ECD (Electro Chromatic Display) apparatus, an EPD (Electro Phorefic Display) apparatus, or a toner display apparatus.

The ECD is constructed as follows. On two pieces of mutually-opposing transparent glass substrates (a micro color filter may be arranged thereon) are formed electrodes of which at least one is transparent. Between the substrates is arranged a solvent of electrolyte prepared by dissolving, for example, LiBF4 in acetonitrile. On one of the electrodes is arranged a conductive high polymer such as polythiophene. When a voltage is applied between the electrodes, as doping is taking place, polythiophene, being a conductive high polymer, undergoes a transition from an insulator to metal state and thus its color is changed from red to blue. Since this reaction is a reversible reaction, by performing dedoping, the color is changed from blue to red. The display color depends on a conductive high polymer material to be used. Specifically, when polypyrrole is in use, the color is changed from yellow to blue, or when poly (o-trimethylsilylphenylacetylene) is in use, the color is changed from red to colorless. Thus, in the ECD, the display medium layer includes, as a display medium, a solvent of electrolyte and a conductive high polymer, and the display condition varies with an insulator-to-metal transition reaction of the conductive high polymer due to a voltage component applied between the electrodes.

The EPD is constructed as follows. On two pieces of mutually-opposing transparent glass substrates (a micro color filter may be arranged thereon) are formed electrodes of which at least one is transparent. Between the substrates is arranged a microcapsule having a diameter of about 50 $\mu$m. Filled in the microcapsule are dispersing liquid (preferably black color) and titanium oxide powder (white color). When a voltage is applied between the electrodes, the titanium oxide contained in the microcapsule migrates between the electrodes in accordance with polarity. When the titanium oxide moves toward the top surface of the display panel, the display panel is brought into a bright state. By contrast, when the titanium oxide moves toward the back surface thereof, the display panel is brought into a dark state. Thus, in the EPD, the display medium layer includes, as a display medium, dispersing liquid and a microcapsule containing titanium oxide powder, and the display condition varies with the movement of the microcapsule containing titanium oxide powder due to a voltage component applied between the electrodes.

The toner display is constructed as follows. On two pieces of mutually-opposing transparent glass substrates (a micro color filter may be arranged thereon) are formed electrodes of which at least one is transparent. Between the substrates are arranged black particles (toner) and white particles. When a voltage is applied between the electrodes, positively-charged toner moves between the electrodes. Moreover, white particles may be charged so as to have a potential opposite to that of the toner. When the toner moves toward the top surface of the display panel (the white particles move toward the back surface thereof), the display panel is brought into a dark state. By contrast, when the toner moves toward the back surface (the white particles move toward the top surface), the display panel is brought into a bright state. Thus, in the toner display, the display medium layer includes, as a display medium, toner and white particles, and the display condition varies with the movement of the toner due to a voltage component applied between the electrodes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for driving a liquid crystal display apparatus, the method comprising the steps of:

(i) providing a first substrate having a first electrode;

a second substrate having a second electrode, the second electrode being opposed to the first electrode; and a display medium layer whose display condition is changeable in accordance with voltage components applied between the first electrode and the second electrode, wherein (a) the first electrode is formed as a pixel electrode, (b) supply/cutoff of display voltages to the pixel electrode are controlled by a thin-film transistor, (c) the second electrode is formed as a counter electrode to which a common electrode is connected, (d) a potential of the common electrode standing at a reference potential level that is an intermediate potential level of the display voltages is shifted by an amount of a first DC voltage component $\Delta V1$ resulting from voltage variation caused by parasitic capacitance of the thin-film transistor so as to be set at a counter potential level, and (e) the potential standing at the counter potential level is further shifted by an amount of a second DC voltage component $\Delta V2$ resulting from difference in characteristics between the substrates so as to be initially set at a correction potential level, and (ii) prior to the use of the apparatus as a display, applying a correction voltage so as to correct a voltage component resulting from differences in characteristics between the first and second substrates.

2. The liquid crystal display apparatus driving method of claim 1, wherein the difference in characteristics between the substrates includes difference in material between the first electrode and the second electrode.

3. The liquid crystal display apparatus driving method of claim 1, wherein the difference in characteristics between the substrates includes difference in film thickness between the first electrode and the second electrode.

4. The liquid crystal display apparatus driving method of claim 1, wherein the first substrate has a first alignment film and the second substrate has a second alignment film, and wherein the difference in characteristics between the substrates includes difference in material between the first alignment film and the second alignment film.

5. A method for driving a liquid crystal display apparatus, the method comprising the steps of:

(i) providing a first substrate having a first electrode;

a second substrate having a second electrode, the second electrode being opposed to the first electrode; and a display medium layer whose display condition is changeable in accordance with voltage components applied between the first electrode and the second electrode, wherein (a) the first electrode is formed as a pixel electrode, (b) supply/cutoff of display voltages to the pixel electrode are controlled by a thin-film transistor, (c) the second electrode is formed as a counter electrode to which a common electrode is connected, (d) a potential of the common electrode standing at a reference potential level that is an intermediate potential level of the display voltages is shifted by an amount of a first DC voltage component $\Delta V1$ resulting from voltage variation caused by parasitic capacitance of the thin-film transistor so as to be set at a counter potential level, (e) the potential standing at the counter potential level is further shifted by an amount of a second DC voltage component $\Delta V2$ resulting from difference in characteristics between the substrates so as to be initially set at a correction potential level, and (f) the first electrode and the second electrode are selected from metallic materials to the surfaces of which dipolar films or layers adhere such that the energy required to remove an electron from the Fermi level of the first electrode to the vicinity of its surface is set so as to be smaller than a the energy required to remove an electron from the Fermi level of the second electrode to the vicinity of its surface thereby facilitating the shifting of the counter potential level by the amount of the second DC voltage component $\Delta V2$; and (ii) prior to the use of the apparatus as a display, applying a correction voltage so as to correct a voltage component resulting from differences in characteristics between the first and second substrates.

6. A method for driving a liquid crystal display apparatus, the method comprising the steps of:

(i) providing a first substrate having a first electrode;

a second substrate having a second electrode, the second electrode being opposed to the first electrode; and a liquid crystal layer interposed between the first substrate and the second substrate, wherein (a) the first electrode is formed as a pixel electrode and supply/cutoff of display voltages to the pixel electrode are controlled by a thin-film transistor, (b) the second electrode is formed as a counter electrode to which a common electrode is connected, (c) a potential of the common electrode standing at a reference potential level that is an intermediate potential level of the display voltages is shifted by an amount of a first DC voltage component $\Delta V1$ resulting from voltage variation caused by parasitic capacitance of the thin-film transistor so as to be set at a counter potential level, and (d) the potential standing at the counter potential level is further shifted by an amount of a second DC voltage component $\Delta V2$ resulting from the difference in characteristics between the substrates so as to be initially set at a correction potential level; and (ii) prior to the use of the apparatus as a display, applying a correction voltage so as to correct a D.C. voltage component resulting from the difference in characteristics between the first substrate and the second substrate which acts upon the liquid crystal layer; and further wherein, in a case where the pixel electrode is a reflecting electrode and the counter electrode is a transparent electrode, the potential of the common electrode standing at the counter potential level is shifted by an amount of the second DC voltage component $\Delta V2$ in a positive potential direction so as to be initially set at a correction potential level.

7. A method for driving a liquid crystal display apparatus, the method comprising the steps of:

(i) providing a first substrate having a first electrode;

a second substrate having a second electrode, the second electrode being opposed to the first electrode; and a liquid crystal layer interposed between the first substrate and the second substrate, wherein (a) the first electrode is formed as a pixel electrode and supply/cutoff of display voltages to the pixel electrode are controlled by a thin-film transistor, (b) the second electrode is formed as a counter electrode to which a common electrode is connected, (c) a potential of the common electrode standing at a reference potential level that is an intermediate potential level of the display voltages is shifted by an amount of a first DC voltage component $\Delta V1$ resulting from voltage variation caused by parasitic capacitance of the thin-film transistor so as to be set at a counter potential level, and (d) the potential standing at the counter potential level is further shifted by an amount of a second DC voltage component $\Delta V2$ resulting from the difference in characteristics between the substrates so as to be initially set at a correction potential level; and (ii) prior to the use of the apparatus as a display applying a correction voltage so as to correct a D.C. voltage component resulting from the difference in characteristics between the first substrate and the second substrate which acts upon the liquid crystal layer; further wherein, in a case where the pixel electrode is a transparent electrode and the counter electrode is a reflecting electrode, the potential of the common electrode standing at the counter potential level is shifted by an amount of the second DC voltage component $\Delta V2$ in a negative potential direction so as to be initially set at the correction potential level.

* * * * *